US012263923B2

(12) United States Patent
Safier

(10) Patent No.: US 12,263,923 B2
(45) Date of Patent: Apr. 1, 2025

(54) FLOATING MODULE OF A FLOATING STRUCTURE AND METHOD FOR JOINING SUCH FLOATING MODULES

(71) Applicant: SAFIER INGENIERIE, Serris (FR)

(72) Inventor: Elchanan Safier, Crecy La Chapelle (FR)

(73) Assignee: SAFIER INGENIERIE, Serris (FR)

( * ) Notice: Subject to any disclaimer, the term of this patent is extended or adjusted under 35 U.S.C. 154(b) by 0 days.

(21) Appl. No.: 18/440,327

(22) Filed: Feb. 13, 2024

(65) Prior Publication Data

US 2024/0208617 A1 Jun. 27, 2024

Related U.S. Application Data

(62) Division of application No. 17/282,023, filed as application No. PCT/EP2019/075403 on Sep. 20, 2019, now Pat. No. 11,932,359.

(30) Foreign Application Priority Data

Oct. 19, 2018 (FR) ..... 1859672

(51) Int. Cl.
*B63B 35/38* (2006.01)
*B63B 35/44* (2006.01)
*E02B 3/06* (2006.01)

(52) U.S. Cl.
CPC ..... *B63B 35/38* (2013.01); *B63B 35/44* (2013.01); *E02B 3/064* (2013.01)

(58) Field of Classification Search
CPC ..... B63B 35/00; B63B 35/38; B63B 35/44; F02B 3/00; F02B 3/064; E02B 3/00
(Continued)

(56) References Cited

U.S. PATENT DOCUMENTS 3,091,203 A * 5/1963 Usab ..... E02B 3/064 114/266
3,951,085 A 4/1976 Johnson et al.
(Continued)

FOREIGN PATENT DOCUMENTS

FR 2597826 A1 10/1987
JP 2000328536 11/2000
(Continued)

OTHER PUBLICATIONS

"International Search Report and Written Opinion in Corresponding International Patent Application No. PCT/EP2019/075403 mailed Jan. 15, 2020. 5 pages.".

*Primary Examiner* — Lars A Olson
(74) *Attorney, Agent, or Firm* — Leason Ellis LLP

(57) ABSTRACT

The invention relates to a floating module (1) comprising a plurality of walls (2) extending between a first longitudinal end (4) and a second longitudinal end (6), the floating module (1) comprising a first partition (8) and a second partition (10) connecting each wall (2) of the plurality of walls, defining an internal volume (12) of the floating module (1), characterized in that the floating module (1) comprises at least one extension (14) emerging from an external face (16) of the wall (2), the extension (14) extending longitudinally in projection from the first longitudinal end (4) or from the second longitudinal end (6), the extension (14) and the wall (2) being materially integral. The invention also relates to a method for joining a first floating module (3) and a second floating module (5).

16 Claims, 11 Drawing Sheets

(58) Field of Classification Search
USPC ..... 114/266
See application file for complete search history.

(56) References Cited

U.S. PATENT DOCUMENTS

| | | | | |
|---|---|---|---|---|
| 4,321,882 | A | 3/1982 | Sluys | |
| 4,365,914 | A | 12/1982 | Sluys | |
| 5,107,785 | A | 4/1992 | Baxter | |
| 6,199,502 | B1 | 3/2001 | Mattson | |
| 9,802,677 | B2 * | 10/2017 | Simola | B63B 35/38 |
| 2016/0214683 | A1 | 7/2016 | Simola | |

FOREIGN PATENT DOCUMENTS

| | | | |
|---|---|---|---|
| KR | 1020160020386 | | 2/2013 |
| RU | 2550579 | C2 | 5/2015 |
| SU | 1446019 | A1 | 12/1988 |

* cited by examiner

FLOATING MODULE OF A FLOATING STRUCTURE AND METHOD FOR JOINING SUCH FLOATING MODULES

CROSS-REFERENCE TO RELATED PATENT APPLICATIONS

This application is a divisional of U.S. patent application Ser. No. 17/282,023, filed Apr. 1, 2021, which is a U.S. National Stage Application under 35 U.S.C. § 371 of International Patent Application No. PCT/EP2019/075403, filed Sep. 20, 2019, which claims the benefit of priority of French Patent Application No. filed Oct. 19, 2018, all of which are incorporated by reference in their entireties. The International Application was published on Apr. 23, 2020, as International Publication No. WO 2020/078662 A1.

The field of the present invention is that of floating structures, such as artificial islands or pontoons. The invention also relates to a method for joining floating modules to form such a floating structure.

In the prior art, so-called monolithic floating structures are known, being formed of a single structural element. These monolithic floating structures have the shortcoming, in particular, of possessing limited dimensions, not allowing one to make a floating structure adapted to the desired dimensions, or requiring specific infrastructure during their fabrication or their transport from their fabrication site to a destination site, considerably increasing their fabrication cost.

So-called modular floating structures are likewise known, comprising multiple distinct floating modules, especially modules made of concrete and joined together to form the modular floating structure. It is known how to ensure a cohesion between the different floating modules by making a cavity in the thickness of one wall of each floating module in the area of a joint between a first floating module and a second floating module. A hollow formed by a first cavity of a first known floating module and a second known floating module is then filled with a material, such as concrete, particularly a liquid material which, when solidified, ensures the cohesion between the first floating module and the second floating module of the known modular floating structure. These known modular floating structures are not entirely satisfactory and have their shortcomings. In fact, since the cavity is made in the thickness of the wall, the thickness of the concrete cast in the hollow is only equal to a fraction of the thickness of the wall. Thus, when the first floating module and the second floating module are joined, only that fraction of the wall thickness provides the mechanical strength of the assembly of the first floating module and the second floating module, thus causing a structural weakness, especially in terms of the static, dynamic, hydrodynamic fatigue strength and tightness, in the area of the joint between the first known floating module and the second known floating module of the known floating structure.

The purpose of the present invention is to propose a floating structure able to deal with all of the shortcomings previously mentioned and, moreover, to provide other advantages. Thus, the purpose of the present invention is to produce a modular floating structure comprising two floating modules which are assembled together and joined by a material cast in a hollow between the first floating module and the second floating module, the hollow having a thickness identical to the thickness of the walls of the floating modules of the floating structure so as to ensure a total mechanical continuity between the first floating module and the second floating module, and to obtain a modular floating structure which behaves like a monolithic structure having the same mechanical strength as the standard section of a floating module.

The invention accomplishes this, according to a first aspect, by a floating module comprising a plurality of walls extending between a first longitudinal end and a second longitudinal end, the floating module comprising a first partition and a second partition connecting each wall of the plurality of walls, defining with these walls an internal volume of the floating module, characterized in that the floating module comprises at least one extension emerging from an external face of the wall, the extension extending longitudinally in projection from the first longitudinal end or from the second longitudinal end, the extension and the wall from which the extension emerges being materially integral.

The walls extend primarily in a longitudinal axis. When implementing the floating module in a floating structure, the longitudinal axis is designed to be horizontal. The first longitudinal end and the second longitudinal end designate the longitudinal ends of a wall and not the longitudinal ends of the floating module.

The first partition and the second partition, in turn, extend in a vertical plane, transversely perpendicular to the longitudinal axis.

The walls and the partitions define the internal volume, which makes possible the floatation of the floating module. In fact, the internal volume is entirely closed or almost entirely closed, the floating module having in this case an opening, especially a technical opening made in one wall or in one partition. Thus, when implementing the floating module on a body of water, such as a sea, an ocean, or a port, the floating module is designed to prevent or diminish the penetration of water inside the internal volume. More particularly, the internal volume of the floating module is designed to be occupied by a material having a specific gravity less than 1, that is, a specific gravity less than that of water. Said material may be, for example, air or a foam such as a foam of polyurethane, polyethylene or polystyrene, such that the floating module has an overall specific gravity less than 1, thus ensuring the floatation of the floating module on the water.

Each wall comprises an internal face and an external face situated at the opposite side of the wall in relation to the internal face, the internal face of the wall being oriented in the direction of the internal volume. Thus, a thickness of the wall is measured between the internal face of the wall and the external face of the wall.

Thus, the extension emerges from the external face of the wall, the extension extending likewise longitudinally in projection from one longitudinal end of the wall, the extension and the wall from which the extension emerges being made of integral material. In other words, the extension and the wall from which the extension emerges are made of the same material, and they do not have any material separation.

This configuration according to the invention makes it possible to realize a modular floating structure comprising at least one floating module according to the first aspect of the invention, said floating structure having a total mechanical continuity between the assembled floating modules and behaving like a monolithic structure with the same mechanical strength as the standard section of a floating module, unlike a known modular floating structure. In fact, the extension and the wall from which the extension emerges of a first floating module according to the invention bound a first cavity. Since the extension emerges from the external face of the wall and extends longitudinally in projection from the longitudinal end of the wall, the cavity has a dimension, so-called first dimension, along a vertical axis perpendicular to a longitudinal and transverse plane formed by the internal face of the wall, the first dimension then representing at least the entire thickness of the wall measured between the external face and the internal face of the wall, this first dimension being also possibly greater than the thickness of the wall measured perpendicularly between the external face and the internal face of the wall. Thus, during the process of joining the first floating module and a second floating module, the cavity enables a positioning of the material connecting the first floating module and the second floating module, and the material can then occupy the entirety of the first dimension of the cavity. Thus, this configuration makes it possible to ensure a total mechanical continuity between the first floating module and a second floating module, and to obtain a modular floating structure which behaves like a monolithic structure having the same mechanical strength as the standard section of a floating module, the cavity bounded by the wall and the extension having a first dimension which may represent at least the entire thickness of the wall.

On the other hand, the mechanical strength of the extension is assured by the material continuity between the extension and the wall from which the extension emerges.

The floating module according to a first aspect of the invention advantageously comprises at least one of the following improvements, it being possible to employ the technical characteristics forming these improvements by themselves or in combination:

one edge of one longitudinal end of the wall and the extension bound a cavity at least partly. The edge designates the face situated at the end of the wall along the longitudinal axis. Thus, when two floating modules are placed one against the other for purposes of being joined, the cavity of the first floating module, so-called first cavity, is opposite the cavity, so-called second cavity, of the second floating module, the first cavity and the second cavity together forming a hollow in which it is possible to pour the material, such as concrete, enabling a structural connection of the first floating module and the second floating module;

a thickness of the cavity is equal to or greater than a thickness of the wall from which the extension emerges. The thicknesses mentioned here are measured along parallel lines. In other words, an internal face of the extension extends in a plane situated beyond a plane in which an external face of the wall is inscribed, toward an exterior environment of the floating module;

an external face of the wall and an internal face of the extension lie in the same plane. The external face of the wall is situated at the opposite side of the wall with respect to the internal face of the wall. The internal face of the extension is oriented toward the cavity. It is understood that the external face of the wall and the internal face of the extension lie in the same plane if the plane difference is less than or equal to 5%, the plane difference being measured by using as reference the thickness of the wall as measured between the internal face of the wall and the external face of the wall. In this particular embodiment, the internal face of the extension and the external face of the wall are co-planar. The first dimension, measured between the internal face of the extension and a longitudinal and transverse plane formed by the internal face of the wall, is equal to a second dimension measured between the external face of the wall and the internal face of the wall. In other words, the second dimension corresponds to the thickness of the wall. Thus, the configuration in which the first dimension of the cavity is equal to or substantially equal to the thickness of the wall makes it possible to ensure a total mechanical continuity between the first floating module and a second floating module, and to obtain a modular floating structure which behaves like a monolithic structure having the same mechanical strength as the standard section of a floating module, in particular as compared to known floating modules in which the first dimension of the cavity represents only a fraction of the second dimension of the wall. In fact, according to the invention, the extension which extends from the external face of the wall makes it possible to configure the cavity such that the first dimension of the cavity is equal to the thickness of the wall, the cavity being designed to be filled with a connection material, such as concrete, in order to join a first floating module and a second floating module of a floating structure, thus allowing the floating structure to assure a total mechanical continuity between the first floating module and a second floating module, and to obtain a modular floating structure which behaves like a monolithic structure having the same mechanical strength as the standard section of a floating module to withstand the mechanical forces acting on it, in particular the forces of compression, making it possible to maintain the first floating module joined to the second floating module, or the mechanical forces produced by the movements of the body of water on which or in which the floating structure lies;

an extension is situated on each of the lateral walls of the floating module and on a bottom wall of the floating module. The lateral walls designate the walls extending primarily in a longitudinal vertical plane when the floating module is implemented on a body of water. The bottom wall designates the wall of the floating module extending primarily in a longitudinal transverse plane when the floating module is implemented on a body of water, the bottom wall being situated at the level of a bottom portion of the floating module, designed in particular to be submerged when the floating module is implemented on a body of water, as compared to an upper portion of the floating module, designed to be emerged when the floating module is implemented on the body of water. Advantageously, the bottom wall joins together the lateral walls of the floating module, beneath a water line, an upper wall situated on the upper portion of the floating module joining together the lateral walls of the floating module, so that the lateral walls are partly immersed and partly emerged. This configuration allows for making tight the volume located between a first floating module and a second floating module which are intended to be joined together, particularly on a body of water, while allowing access, in particular for a technician who needs to carry out the various steps needed for the joining of the first floating module and the second floating module, to the volume located between the first floating module and the second floating module, especially in the area of the upper portion of the floating module, the upper wall being in particular free of the extension, and thus forming a passage allowing access for a technician;

the extension extends over the entire width of the wall along a transverse axis perpendicular to the longitudinal axis;

advantageously, the extension situated on a first wall is joined by integral material to an extension situated on a second wall directly adjacent to the first wall. This configuration makes it possible to assure a total mechanical continuity between the first floating module and a second floating module, and to obtain a modular floating structure which behaves like a monolithic structure having the same mechanical strength as the standard section of a floating module and a tight joint between the extension situated on the first wall and the extension situated on the second wall;

the wall comprises a first extension situated in the area of the first longitudinal end and a second extension situated in the area of the second longitudinal end. The wall designates in particular a single wall of the floating module, or also each wall of the floating module, or also all of the lateral walls and/or the bottom walls of the floating module. This configuration enables a simple connection between the first floating module and the second floating module according to the first aspect of the invention, the first floating module and the second floating module being then joined together in the area of their respective extensions. More particularly and advantageously, a first extension situated on the first floating module is designed to be connected to a second extension situated on the second floating module;

the plurality of walls, the first partition, the second partition and the extension are formed of integral material, said material being concrete. In other words, the overall backbone of the floating module is made of concrete. This configuration makes it possible to assure a total mechanical continuity between the first floating module and a second floating module, and to obtain a modular floating structure which behaves like a monolithic structure having the same mechanical strength as the standard section of a floating module to withstand the mechanical forces, especially those of compression. Moreover, this configuration enables a simple fabrication of the floating module, which can be formed with the help of formwork in which concrete in the liquid state is poured. Advantageously, the concrete is reinforced, that is, at least one metal reinforcement passes through it, improving the strength of the floating module with respect to mechanical forces, especially traction forces. Advantageously, the concrete is prestressed, that is, a prestressing cable extends through the concrete, and a traction force is applied to the prestressing cable, making it possible to apply a compression force corresponding to the floating module, the concrete forming the floating module being thus subjected to the compression force, to which the concrete is highly resistant as compared to a traction force, to which the concrete is only slightly resistant;

a metal reinforcement extends inside one wall and emerges into the cavity. Thus, the metal reinforcement extends along the longitudinal axis. In other words, the metal reinforcement is situated in the thickness of the wall, that is, between the internal face and the external face of the wall. It is understood that the metal reinforcement emerges into the cavity when it reaches the cavity, that is, when the metal reinforcement extends longitudinally up to the edge of the longitudinal end of the wall, or when the metal reinforcement extends inside the cavity. The metal reinforcement improves the resistance of the floating module to mechanical forces, especially traction forces. On the other hand, the metal reinforcement of a first floating module is designed to be coupled to a metal reinforcement of a second floating module in order to assure a total mechanical continuity of the reinforcements between the first floating module and a second floating module, and to obtain a modular floating structure which behaves like a monolithic structure having the same mechanical strength of the reinforcements as the standard section of a floating module in order to withstand the mechanical forces, especially traction forces, of the floating structure formed by the first floating module and the second floating module. Advantageously, the coupling of the metal reinforcement of the first floating module and the metal reinforcement of the second floating module allows one to assure the relative position of the first floating module with respect to the second floating module when joining the first floating module and the second floating module. Advantageously, in combination with the preceding characteristic, the backbone of the floating module is made of concrete, assuring a total mechanical continuity of the concrete between the first floating module and a second floating module, and making it possible to obtain a modular floating structure which behaves like a monolithic structure having the same mechanical strength of the concrete as the standard section of a floating module to resist the mechanical forces of compression, while the metal reinforcement ensures the resistance to the mechanical forces of traction;

the floating module comprises a prestressing sheath extending inside one wall and emerging into the cavity. Thus, the prestressing sheath extends along the longitudinal axis. In other words, the prestressing sheath is situated in the thickness of the wall, that is, between the internal face and the external face of the wall. It is understood that the prestressing sheath emerges into the cavity when it reaches the cavity, that is, when the prestressing sheath extends longitudinally as far as the edge of the longitudinal end of the wall, or when the prestressing sheath extends inside the cavity. The prestressing sheath is designed to receive a prestressing cable formed by a multitude of strands, the prestressing cable being lodged inside the prestressing sheath. More particularly, the prestressing sheath is designed to receive a metallic prestressing cable formed by a multitude of metallic strands, the metallic strands being preferably twisted. Thus, when a plurality of floating modules aligned on the same axis of alignment are joined to each other, the prestressing cable is inserted in the prestressing sheath of each floating module, each prestressing sheath of a first floating module being adapted to being aligned with a prestressing sheath of a second adjacent floating module. Thus, the prestressing cable extends through the cavity of the first floating module and the cavity of the second floating module when the first floating module and the second floating module are joined together. The prestressing cable is then placed under tension in order to exert a compression force on the assemblage of floating modules aligned on the axis of alignment, this placing under tension making it possible for each floating module, made of concrete, to undergo a compression force, to which the concrete presents an elevated resistance, while the floating module is then subjected potentially only to a slight traction force, to which the concrete presents a slight resistance. The configuration in which the prestressing cable extends through the cavity of the first floating module and the cavity of the second floating module makes it possible to ensure that the force of compression exerted by the prestressing cable is exerted in the plane of the cavity of the first floating module and the cavity of the second floating module. In other words, the force of compression exerted by the prestressing cable is not off-center with respect to the surface on which the force of compression is exerted. This configuration also makes it possible, especially in a particular embodiment in which a floating structure comprises at least three floating modules joined along the same axis, to join together all of these floating modules by the prestressing cable, the force of compression then being exerted by the prestressing cable on all of said floating modules, assuring a total mechanical continuity between the first floating module and a second floating module, and making it possible to obtain a modular floating structure which behaves like a monolithic structure having the same mechanical strength as the standard section of a floating module.

preferably, the prestressing cable has a diameter which is larger than the diameter of a metal reinforcement;

advantageously, the floating module has a longitudinal dimension between five meters and a hundred meters, or any desired length. The invention may be utilized in order to assure a total mechanical continuity between the first floating module and a second floating module, and to obtain a modular floating structure which behaves like a monolithic structure having the same mechanical strength as the standard section of a floating module. The longitudinal dimension of the floating module is measured between a first longitudinal termination and a second longitudinal termination of the floating module, the first longitudinal termination being situated in the area of a first end of the first extension extending longitudinally in projection from the wall, the second longitudinal termination being situated at the opposite side of the floating module in regard to the first termination along the longitudinal axis. The second termination may be formed in particular by a second end of a second extension situated at the opposite side of the wall with respect to the first extension along the longitudinal axis. In other words, the floating module extends longitudinally between the first longitudinal termination and the second longitudinal termination. This configuration allows the fabrication of a large-size floating module while still being buildable and transportable in a simple manner by the existing means;

the plurality of walls of the floating module is between three and six walls, particularly four walls;

preferably, the floating module may have the shape of a straight pavement. Alternatively, the floating module may have an L-shape, thus making it possible to create an angle in the area of the walls of the floating module. Preferably, said angle is close to 90°, plus or minus 10°, thus making it possible to create a floating structure having an overall rectangular shape, said floating module then forming one corner of the floating structure. Alternatively, the floating module may have any other shape;

the floating module explained below may comprise a sealing device integrated with the extension. In particular, this sealing device may be arranged at one end bounding the extension, this end forming a longitudinal termination of the floating module.

According to a second aspect, the invention also relates to a floating structure comprising at least one floating module according to the first aspect of the invention.

This configuration according to the second aspect of the invention makes possible in particular the forming of a floating structure, such as a bridge, an oil drilling platform, a port, a pier, a floating platform for renewable energy, a nuclear structure, an artificial island, or any other type of floating structure. More particularly, this configuration enables the construction of a so-called modular floating structure, that is, one formed from multiple distinct floating modules joined together. In fact, the construction of a large-size modular floating structure is simplified as compared to the construction of a monolithic floating structure formed from a single large-size structural element. In fact, the construction of a monolithic floating structure requires, for example, specific infrastructure or means of transport adapted to the transporting of the monolithic floating structure from its place of fabrication to its place of destination, while in the case of a modular floating structure the floating modules forming said modular floating structure are individually of a size less than the size of the modular floating structure. Moreover, the floating modules can also be joined together in order to form the modular floating structure directly at the place of destination of the modular floating structure, eliminating the transportation constraints on the floating structure. On the other hand, the invention makes it possible to assure a total mechanical continuity between the first floating module and a second floating module, and to obtain a modular floating structure which behaves like a monolithic structure having the same mechanical strength as the standard section of a floating module, unlike a known modular floating structure, thanks to the use of a floating module according to the first aspect of the invention.

The floating structure according to the second aspect of the invention advantageously comprises at least one of the following improvements, it being possible to employ the technical characteristics forming these improvements by themselves or in combination:

advantageously, the floating structure comprises a plurality of floating modules, all of the floating modules of the plurality of floating modules being according to the first aspect of the invention. Alternatively, only a fraction of the floating modules of the plurality of floating modules are according to the first aspect of the invention;

a sealing device is located between a first floating module and a second floating module, the sealing device being inserted between an extension of the first floating module and an extension of the second floating module. This may be the sealing device described above in connection with the floating module. Advantageously, the sealing device is inserted between a lateral wall and/or a bottom wall of the first floating module and a lateral wall and/or a bottom wall of the second floating module. The sealing device makes it possible to ensure a tight connection between the first floating module and the second floating module. Thus, when the first floating module and the second floating module are joined together, the sealing device, which has a certain elasticity, is crushed, ensuring the tightness of the interface between the first floating module and the second floating module. Advantageously, the sealing device is integrated with one or the other extension of the first floating module or the second floating module. Preferably, the sealing device is a gasket, especially a gasket made of rubber or plastic;

a hollow bounded by a cavity of the first floating module and by a cavity of the second floating module is filled with concrete. This configuration enables the joining together and the cohesion between the first floating module and the second floating module of the floating structure. More particularly and advantageously, this configuration enables a monolithic assemblage, the first floating module and the second floating module being joined together by a casting of concrete in the hollow, making it possible to realize a material continuity between the first floating module and the second floating module, the first floating module and the second floating module being made advantageously of concrete. In other words, the material present in the hollow is identical to the material forming the first floating module and the second floating module. Thus, this configuration makes it possible to assure a total mechanical continuity between the first floating module and a second floating module, and to obtain a modular floating structure which behaves like a monolithic structure having the same mechanical strength as the standard section of a floating module to withstand the mechanical forces, especially compression forces, of the floating structure, the concrete cast in the hollow assuring the transmission of the mechanical forces between one wall of the first floating module and one wall of the second floating module, thus ensuring the transfer of forces, especially compression forces, between the first floating module and the second floating module;

a continuity between a metal reinforcement of the first floating module and a metal reinforcement of the second floating module, and/or a continuity between a prestressing sheath of the first floating module and a prestressing sheath of the second floating module, is realized in the hollow. The continuity between the metal reinforcement of the first floating module and the metal reinforcement of the second floating module is realized in particular by a coupler, thus allowing the transfer of mechanical forces, especially traction forces, between the first floating module and the second floating module. The continuity between the prestressing sheath of the first floating module and the prestressing sheath of the second floating module is realized in particular by a hollow sleeve, thus allowing the laying of the prestressing cable between the first floating module and the second floating module, thus allowing the transmission of the force of compression, exerted by the force of traction applied to the prestressing cable, between the first floating module and the second floating module. Thus, this configuration makes it possible to assure a continuity of material, especially reinforced and/or prestressed concrete, between the first floating module and the second floating module to form a monolithic floating structure having the same mechanical strength as the standard section of a floating module. Hence, the floating structure behaves like a non-modular monolithic structure able to withstand, for the different stages of the lifetime of the floating structure, the static and dynamic forces, the hydrodynamic forces, and the fatigue phenomena acting upon it, in accordance with international regulations;

a thickness of the wall of the first floating module is equal to a thickness of the wall of the second floating module, the thickness of the wall of the first floating module and the thickness of the wall of the second floating module being equal to or less than a thickness of the hollow. The thickness of each wall is defined between the external face and the internal face of that wall. The thickness of the hollow corresponds to the first dimension of the first cavity, as well as the first dimension of the second cavity. It is understood that two thicknesses are equal to each other if the difference of thickness is less than or equal to 5%, taking as the reference the thickness of the hollow. Advantageously, the external face of the wall of the first floating module and the external face of the wall of the second floating module lie in the same plane. In one embodiment, the internal face of the extension emerging from the first floating module and the internal face of the extension emerging from the second floating module lie in the same plane, said plane being advantageously the plane formed by the external face of the wall of the first floating module and by the wall of the second floating module. In a similar manner, the internal face of the wall of the first floating module and the internal face of the wall of the second floating module lie in the same plane. Thus, this configuration makes it possible to obtain a complete continuity of the thickness of the wall of the first floating module and the wall of the second floating module in the area of the hollow, the hollow being intended to be filled, in particular with concrete. Thus, this configuration assures a total mechanical continuity between the first floating module and a second floating module, and makes it possible to obtain a modular floating structure which behaves like a monolithic structure having the same mechanical strength as the standard section of a floating module, the thickness of the hollow representing the entire thickness of the wall of the first floating module and the entire thickness of the second floating module;

the floating structure may be, in particular, a bridge, an oil drilling platform, a port, a pier, a floating platform for renewable energy, a nuclear structure, an artificial island, or any other type of floating structure.

According to a third aspect, the invention also relates to a method for assembling a floating structure according to the second aspect of the invention, the assembly method involving a step of alignment of the first floating module relative to the second floating module, a step of removable coupling of the first floating module to the second floating module, a step of coupling of the reinforcements, the prestressing sheaths, and the prestressing cables, and a step of casting concrete in the hollow.

The step of alignment of the first floating module with respect to the second floating module makes it possible to place the first cavity against the second cavity. Thus, a longitudinal termination of the first floating module is placed opposite a longitudinal termination of the second floating module. In other words, the step of alignment of the first floating module with respect to the second floating module makes it possible to position the first floating module and the second floating module in the same longitudinal axis. The first floating module and the second floating module are then brought closer together in order to allow the step of removable coupling.

The step of removable coupling makes use of a connecting frame in order to secure the position of the first floating module and the second floating module during the assembly process, in particular when the assembly process is carried out directly on a body of water, which might cause movements of the first floating module relative to the second floating module. The connecting frame is located at the periphery of the floating modules, the connecting frame being joined, in a removable manner, to both the first floating module and the second floating module. Thus, when the assembly process according to the third aspect of the invention is finished, the connecting frame can be removed. In one embodiment, the connecting frame is secured on the first floating module prior to the coming together of the first floating module and the second floating module. Alternatively, the connecting frame is secured on the first floating module and then on the second floating module once the coming together of the first floating module and the second floating module has been accomplished. On the other hand, the step of removable coupling also allows the sealing device to assure the tightness of the interface between the first floating module and the second floating module.

During the pouring step, concrete in the liquid state is poured into the hollow formed by the first cavity and the second cavity, the concrete after it solidifies thus assuring the mechanical resistance to the forces of compression, as well as the cohesion between the first floating module and the second floating module, the first floating module and the second floating module together forming a monolithic assemblage.

The assembly method according to the third aspect of the invention advantageously comprises at least one of the following improvements, it being possible to employ the technical characteristics forming these improvements by themselves or in combination:

the assembly method involves a step of emptying a space bounded by the partitions, by the extension of the first floating module and by the extension of the second floating module. The space is located between the first floating module and the second floating module. This configuration in particular allows an implementing of the assembly method on a body of water, where the water can then penetrate into the space prior to the coupling step, when the sealing device does not yet assure the tightness of the interface between the first floating module and the second floating module. Thus, the emptying step makes it possible to remove the water present in the space, and especially the water in the hollow located between the first floating module and the second floating module. Advantageously, the emptying step is carried out directly after the removable coupling step, that is, once the sealing device assures the tightness of the space between the first floating module and the second floating module;

the assembly method involves a step of mechanical connection between the metal reinforcement of the first floating module and the metal reinforcement of the second floating module, the mechanical connection step taking place prior to the concrete pouring step. In fact, since the reinforcement is located in the thickness of the wall and emerges into the cavity, it is necessary to proceed with the mechanical connection step prior to the filling of the cavity with concrete. Advantageously, the mechanical connection step takes place after the removable coupling step or after the emptying step, if present, thus allowing an easier mechanical connection step;

the assembly method involves a step of mechanical connection between the prestressing sheath of the first floating module and the prestressing sheath of the second floating module, the mechanical connection step occurring prior to the concrete pouring step. In fact, since the prestressing sheath is located in the thickness of the wall and emerges into the cavity, it is necessary to proceed with the mechanical connection step prior to the filling of the cavity with concrete. Advantageously, the mechanical connection step takes place after the removable coupling step or after the emptying step, if present, thus allowing an easier mechanical connection step;

the assembly method involves, after the step of concrete casting, a step of installation of at least one prestressing cable laid in the prestressing sheath of the first floating module and in the prestressing sheath of the second floating module, a traction force being then applied to the prestressing cable. In one embodiment in which at least two, preferably three floating modules are aligned on the same axis in order to be joined together, thus forming a multitude of floating modules, the prestressing cable is laid in the prestressing sheath of each of the floating modules of the multitude of floating modules, and the traction force is then applied to the prestressing cable. The traction force applied to the prestressing cable makes it possible to apply a compression force corresponding to the floating modules through which the prestressing cable has been laid, thus ensuring a holding of the floating modules of the multitude of floating modules against one another. On the other hand, the compression force exerted by the prestressing cable makes it possible to ensure that the concrete contained in the walls and/or in the hollow experiences a mechanical force of compression to which the concrete has an elevated resistance, and not a mechanical force of traction to which the concrete has slight resistance.

Other characteristics, details and advantages of the invention will emerge more clearly upon reading the following description, on the one hand, and from several exemplary embodiments, provided for information and not for limitation, with reference to the accompanying schematic drawings, on the other hand, there being shown:

Figure 11A:
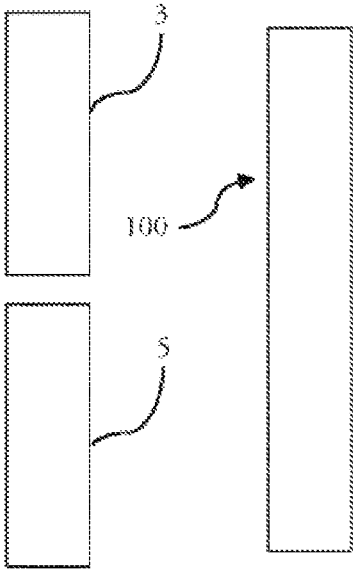
Figure 11B:
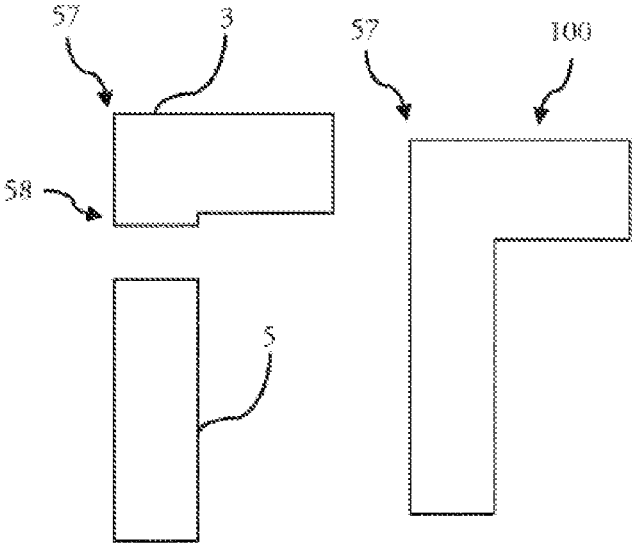
Figure 12A:
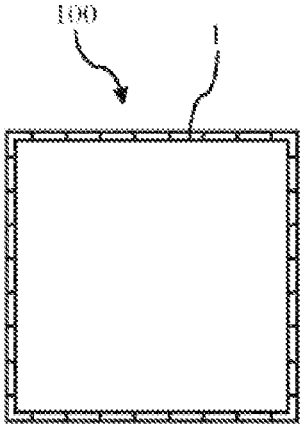
Figure 12B:
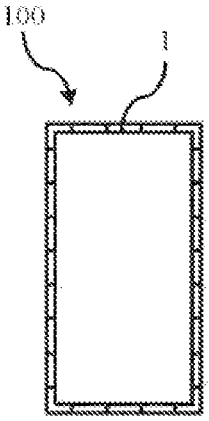
Figure 12C:
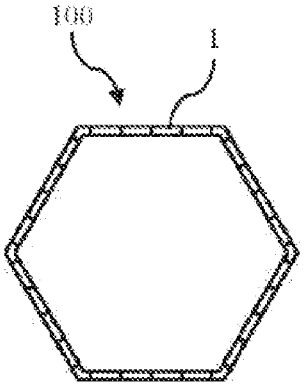
Figure 12D:
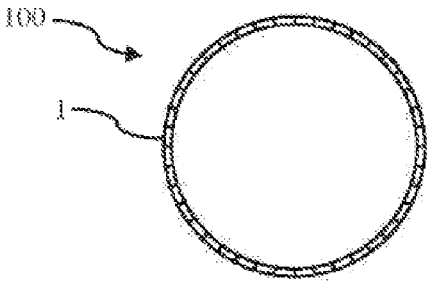
Figure 12E:
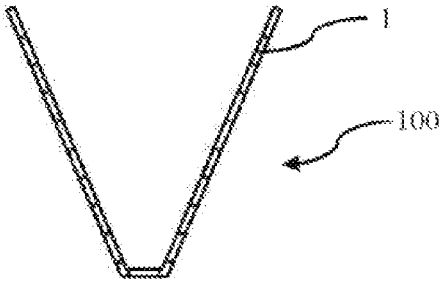

FIGS. 11*a* and 11*b* illustrate a first mode of assembly and a second mode of assembly, respectively, of a first floating module and a second floating module designed to form a floating structure;

FIGS. 12*a* to 12*e* illustrate exemplary embodiments of a floating structure according to the second aspect of the invention.

The characteristics, the variants and the different embodiments of the invention may be associated with one another in different combinations, as long as they are not incompatible or mutually exclusive with each other. In particular, one could conceive of variants of the invention comprising only a selection of characteristics described hereafter in isolation from other characteristics described, if this selection of characteristics is sufficient to confer a technical advantage or to differentiate the invention with regard to the prior art.

In particular, all the variants and all the embodiments described can be combined with each other, if nothing prevents such a combination in technical respects.

Figure 1:
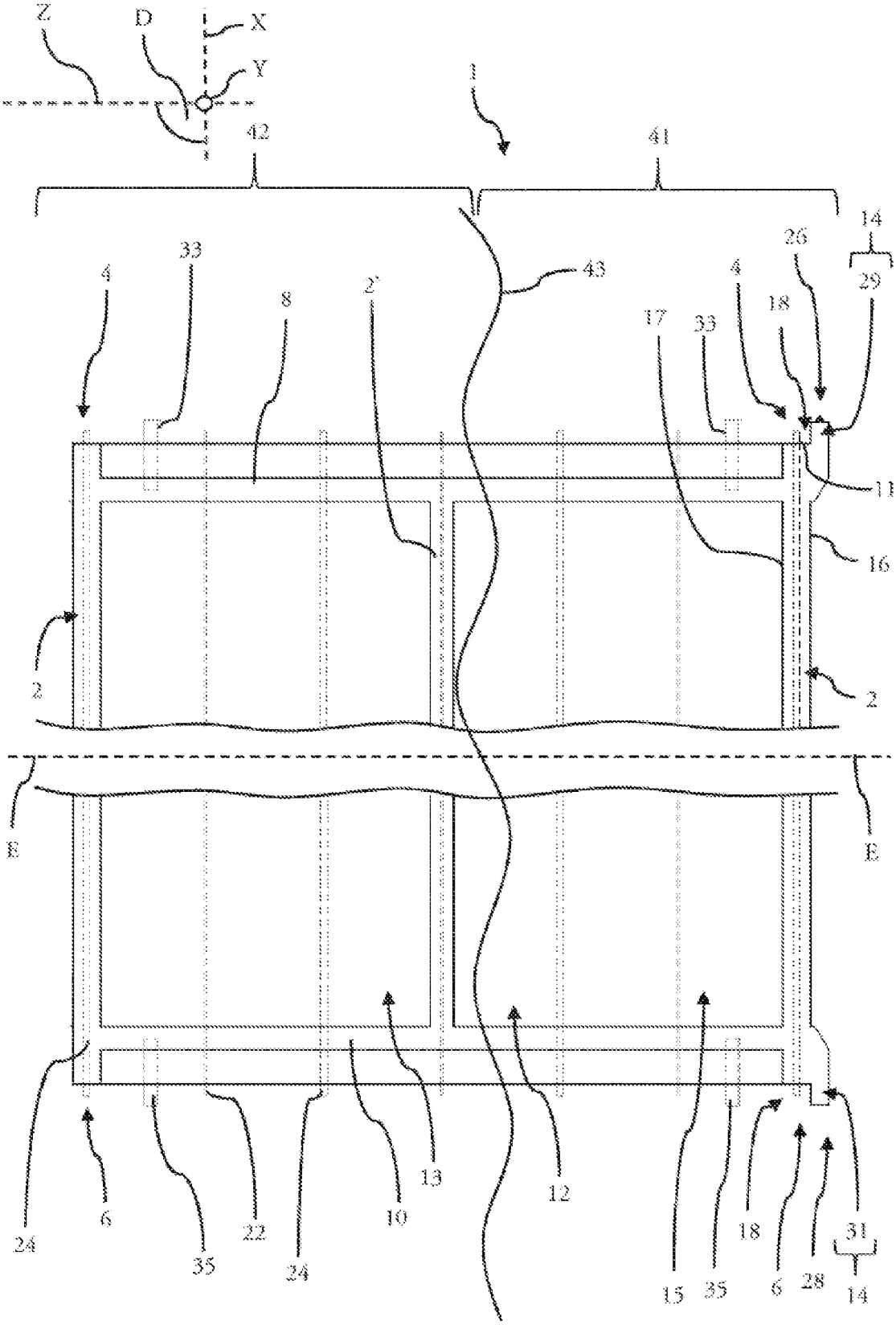
FIG. 1 is a partial view, in cross section, of an exemplary embodiment of a floating module according to the first aspect of the invention.

FIG. 1 illustrates a partial view, in cross section, of an exemplary embodiment of a floating module 1 according to the first aspect of the invention. Thus, the floating module 1 extends primarily along a longitudinal axis X between a first termination 26 and a second termination 28. The floating module likewise extends along a vertical axis Z perpendicular to the longitudinal axis X, the longitudinal axis X and the vertical axis Z forming a plane D, illustrated in FIG. 1. Thus, FIG. 1 illustrates a side view in cross section of the floating module 1. The floating module 1, finally, extends along the transverse axis Y perpendicular to the plane D.

The floating module 1 comprises a plurality of walls, each wall 2 extending along the longitudinal axis X between a first longitudinal end 4 and a second longitudinal end 6. The walls 2 are joined together by a first partition 8 and a second partition 10 situated respectively in proximity to the first longitudinal end 4 and the second longitudinal end 6. Thus, the plurality of walls, the first partition 8 and the second partition 10 define an internal volume 12, substantially closed, which is designed to be filled with a material having a specific gravity less than that of water, in order to ensure the floatation of the floating module 1. Hence, a first portion 41 of the floating module 1 is submerged, that is, situated beneath a water line 43, while a second portion 42 situated at the opposite side of the floating module in regard to the first portion 41 along the vertical axis Z is emerged, that is, situated above the water line, in the air.

In the embodiment illustrated, the internal volume 12 is traversed by an intermediate wall 2' extending primarily in the longitudinal axis between the first partition 8 and the second partition 10, the internal volume 12 thus forming a first chamber 13 and a second chamber 15. The intermediate wall 2' makes it possible to reinforce the structure of the floating module 1.

Thus, each wall 2 comprises an internal face 17 and an external face 16 situated on the opposite side of the wall 2 in regard to the internal face, said internal face 17 being oriented toward the internal volume 12.

A plurality of metal reinforcements 22 extend longitudinally through the floating module, each metal reinforcement 22 being designed to be connected to a metal reinforcement 22 of a second floating module. Thus, the metal reinforcements 22 make it possible to join together multiple floating modules. On the other hand, the metal reinforcements 22 make it possible to ensure the resistance of the floating module 1 and the floating structure to mechanical forces, more particularly to mechanical traction forces, especially in the case when the walls 2, the first partition 8 and the second partition 10 of the floating module are made of a material such as concrete, which is highly resistant to mechanical compression forces but little resistant to mechanical traction forces. It will be noted that, in the exemplary embodiment illustrated, a metal reinforcement 22 extends inside the intermediate wall 2'.

In a similar manner, the floating module 1 comprises a plurality of prestressing sheaths 24 extending longitudinally through the floating module 1, each prestressing sheath 24 being designed to be connected to a prestressing sheath 24 of a second floating module. Each prestressing sheath 24 is configured to receive, once all of the floating modules have been joined together and aligned along the same axis, a prestressing cable passing through the prestressing sheath 24. Once the prestressing cable is laid through the prestressing sheath of each of the floating modules aligned on the same axis, a traction force is applied to the prestressing cable, making it possible to exert a compression force corresponding to said floating modules. In the exemplary embodiment illustrated, a prestressing sheath 24 extends inside each wall 2, said prestressing sheath being arranged through the material making up the wall, between the internal face 17 and the external face 16. It should be noted that a metal reinforcement 22 and/or a prestressing sheath 24 may be situated in any place of the floating module, in particular inside a wall 2, the metal reinforcement 22 and/or the prestressing sheath 24 extending primarily longitudinally.

An extension 14 emerges from the external face 16 of the first longitudinal end 4. Another extension 14 emerges likewise from the second longitudinal end 6 of each wall 2. In other words, each wall 2 comprises a first extension 29 in the area of its first longitudinal end 4 and a second extension 31 in the area of its second longitudinal end 6. Thus, the extension 14 and the wall 2 are made of integral material.

Each extension 14 extends longitudinally in projection from the longitudinal end 4, 6 of the wall 2 from which said extension 14 extends, that is, the extension 14 extends longitudinally beyond an edge 11 of the wall formed by the first longitudinal end 4 or the second longitudinal end 6 of said wall, the extension 14 and the edge 11 of the wall thus bounding a cavity 18. The cavity 18 is designed to be filled with a material such as concrete, making it possible to assure a total mechanical continuity between the first floating module and a second floating module, and to obtain a modular floating structure which behaves like a monolithic structure having the same mechanical strength as the standard section of a floating module.

The floating module 1 comprises two first end stops 33 each extending longitudinally from the first partition 8 in a direction opposite the internal volume 12. In a similar manner, the floating module 1 comprises two second end stops 35 each extending longitudinally from the second partition 10 in a direction opposite the internal volume 12. Thus, the first end stops 33 and the second end stops 35 are designed to make contact with end stops present on a second floating module which is going to be joined to the floating module 1, the first end stops 33 and the second end stops 35 thus making it possible to define, when the floating module 1 is brought closer to the second floating module in order to form a floating structure, the moment at which the floating module 1 and the second floating module are sufficiently close to each other.

Figure 2:
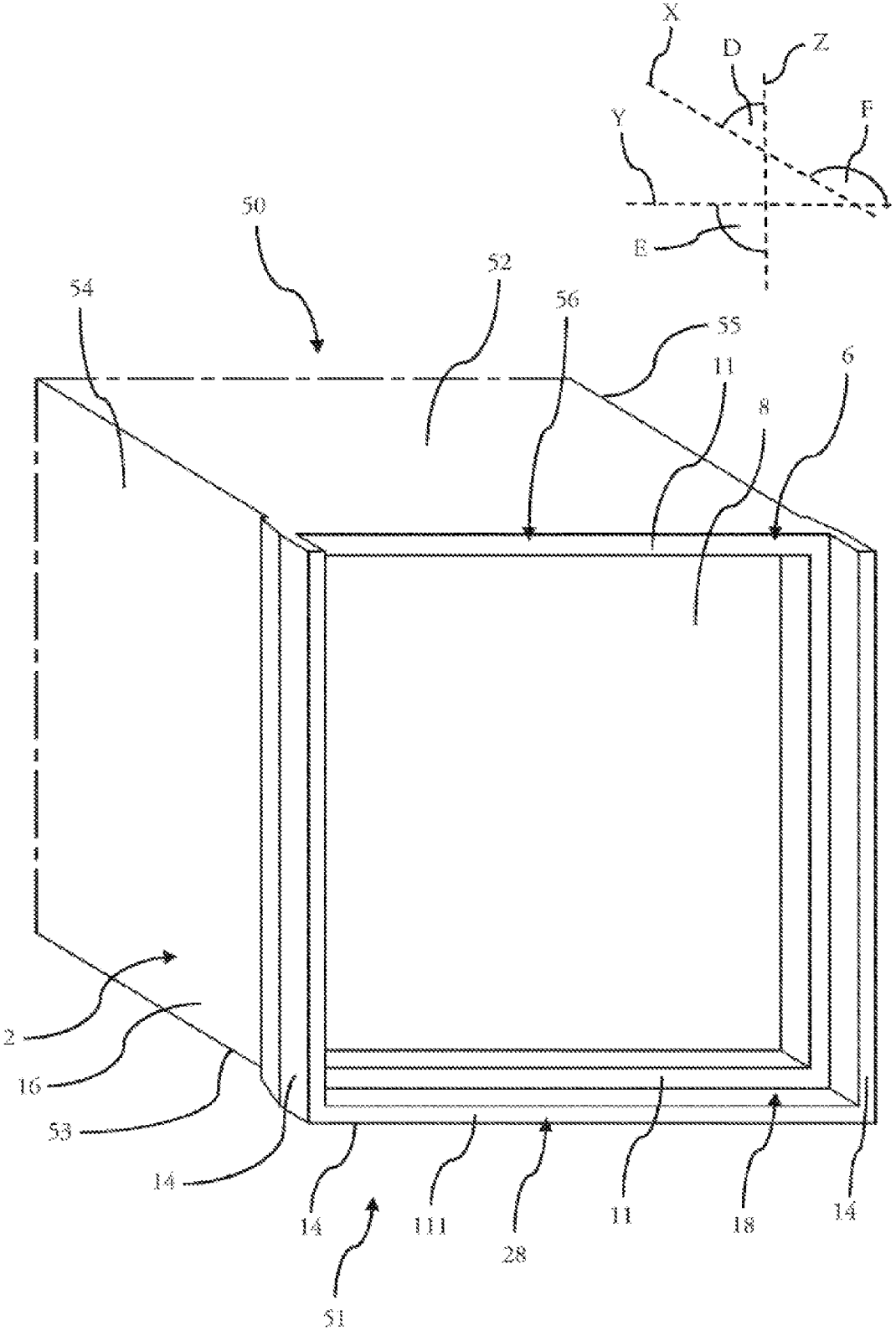
FIG. 2 is a perspective view of the floating module illustrated in FIG. 1.

FIG. 2 illustrates a perspective view of the floating module illustrated in FIG. 1. It is thus seen that the floating module 1 extends likewise in a plane E, the so-called second plane E, comprising the transverse axis Y and the vertical axis Z, the second plane E being thus perpendicular to the longitudinal and vertical plane D, the so-called first plane D.

The floating module 1 comprises an upper portion 50 designed to be oriented vertically upward when the floating module 1 is constructed on a body of water. The floating module thus also comprises a lower portion 51 situated at the opposite side of the floating module 1 in relation to the upper portion 50 along the vertical axis Z, the lower portion being designed to be submerged when the floating module 1 is constructed on a body of water.

The upper portion 50 comprises an upper wall 52 extending primarily in a third plane F comprising the transverse axis Y and the longitudinal axis X. In a similar manner, the lower portion 51 comprises a lower wall 53 extending primarily in the third plane F.

The floating module 1 comprises a first lateral wall 54 and a second lateral wall 55 extending primarily in the first plane D. The first lateral wall 54, the second lateral wall 55, the upper wall 52 and the lower wall 53 are arranged so that the first lateral wall 54 and the second lateral wall 55 are joined together by the upper wall 52 and the lower wall 53, the upper wall 52 and the lower wall 53 being joined together by the first lateral wall 54 and the second lateral wall 55. The upper wall 52, the lower wall 53, the first lateral wall 54 and the second lateral wall 55 in particular may each form a wall 2 in the sense of the invention.

It will be noted that, in the exemplary embodiment illustrated, the lower wall 53, the first lateral wall 54 and the second lateral wall 55 each comprise an extension 14. On the other hand, the upper wall 52 is lacking in an extension, the upper wall 52 thus forming a passage 56, in particular allowing easier access of a technician to a space located between the floating module and a second floating module which is going to be attached in order to form a floating structure.

Figure 3:
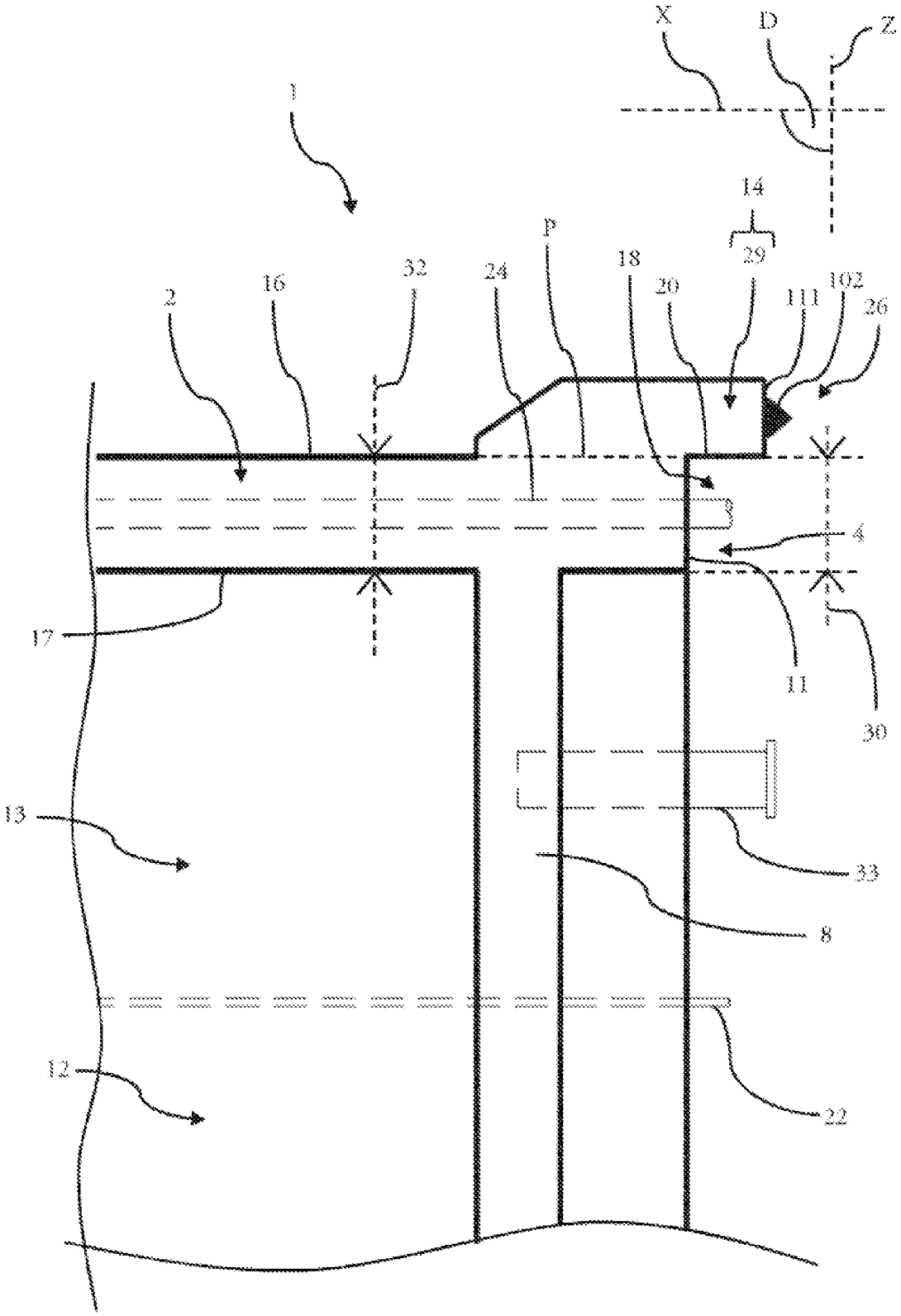
FIG. 3 is a detail view, in cross section, in the area of a first longitudinal termination of the floating module illustrated in FIGS. 1 and 2.

FIG. 3 is a detail view, in cross section, in the area of the first longitudinal termination 26 of the floating module 1 illustrated in FIGS. 1 and 2.

Thus, one may see that the extension 14 and the edge 11 of the wall are arranged so that the external face 16 of the wall and an internal face 20 of the extension 14, said internal face 20 of the extension being oriented toward the cavity 18, lie in the same plane P. More particularly, the cavity 18 extends along a first dimension 30, measured between the internal face 20 of the extension and a plane P formed by the internal face 17 of the wall 2 from which the extension 14 emerges. In a similar manner, the wall 2 extends along a second dimension 32, measured between its external face 17 and its internal face 16, the second dimension 32 thus corresponding to the thickness of the wall 2, the first dimension 30 being equal to the second dimension 32. It should be noted that the internal face of the extension and the external face of the wall are considered to lie in the same plane P if the difference between the first dimension 30 and the second dimension 32 is not more than 5% of the second dimension 32.

In one alternative of the invention, it is considered that the first dimension 30 is greater than the second dimension 32. In such a case, the extension reaches further peripherally and the minimum thickness needed to ensure the material continuity between two adjacent floating modules is assured.

Thus, the material designed to fill the cavity 18 makes it possible to prolong the wall 2 longitudinally along the entire second dimension of the wall 2, in other words, along the entire thickness of the wall. Thus, this configuration, when the floating module 1, so-called first floating module, is joined to an adjacent floating module, so-called second floating module, to form a floating structure according to the second aspect of the invention, makes it possible to assure a total mechanical continuity between the first floating module and a second floating module, and to obtain a modular floating structure which behaves like a monolithic structure having the same mechanical strength as the standard section of a floating module to withstand the mechanical forces, especially the compression forces, by the material filling the cavity, and more particularly the entire cavity 18, along the first dimension 30 of said cavity.

A scaling device 102 is situated at one longitudinal end 111 of the first extension 29. The sealing device 102 is in particular a gasket designed to be compressed between a first floating module and a second floating module in order to ensure the tightness of a space located between the first floating module and the second floating module. This sealing device 102 may be integrated with the first floating module or the second floating module.

The metal reinforcement 22 extends longitudinally in projection from the first longitudinal end 4 of the wall. In a similar manner, the prestressing sheath 24 extends longitudinally in projection from the first longitudinal end 4 of the wall, and in particular inside the wall, the prestressing sheath thus emerging into the cavity 18.

Figure 4:
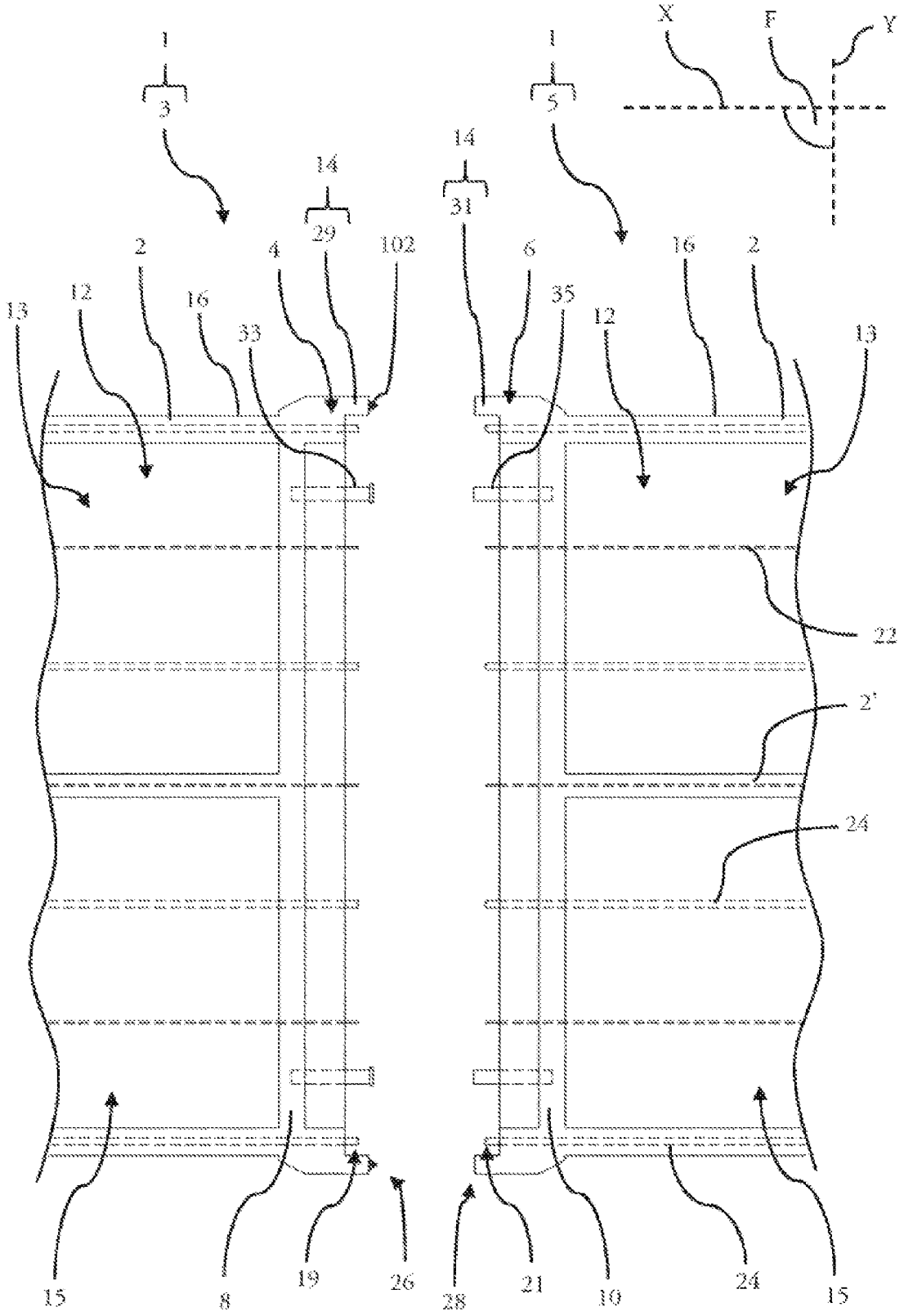
FIGS. 4 and 5 illustrate partial views, respectively in cross section and in perspective, of an exemplary embodiment of a first floating module and a second floating module designed to be joined together to form a floating structure according to the second aspect of the invention.
Figure 5:
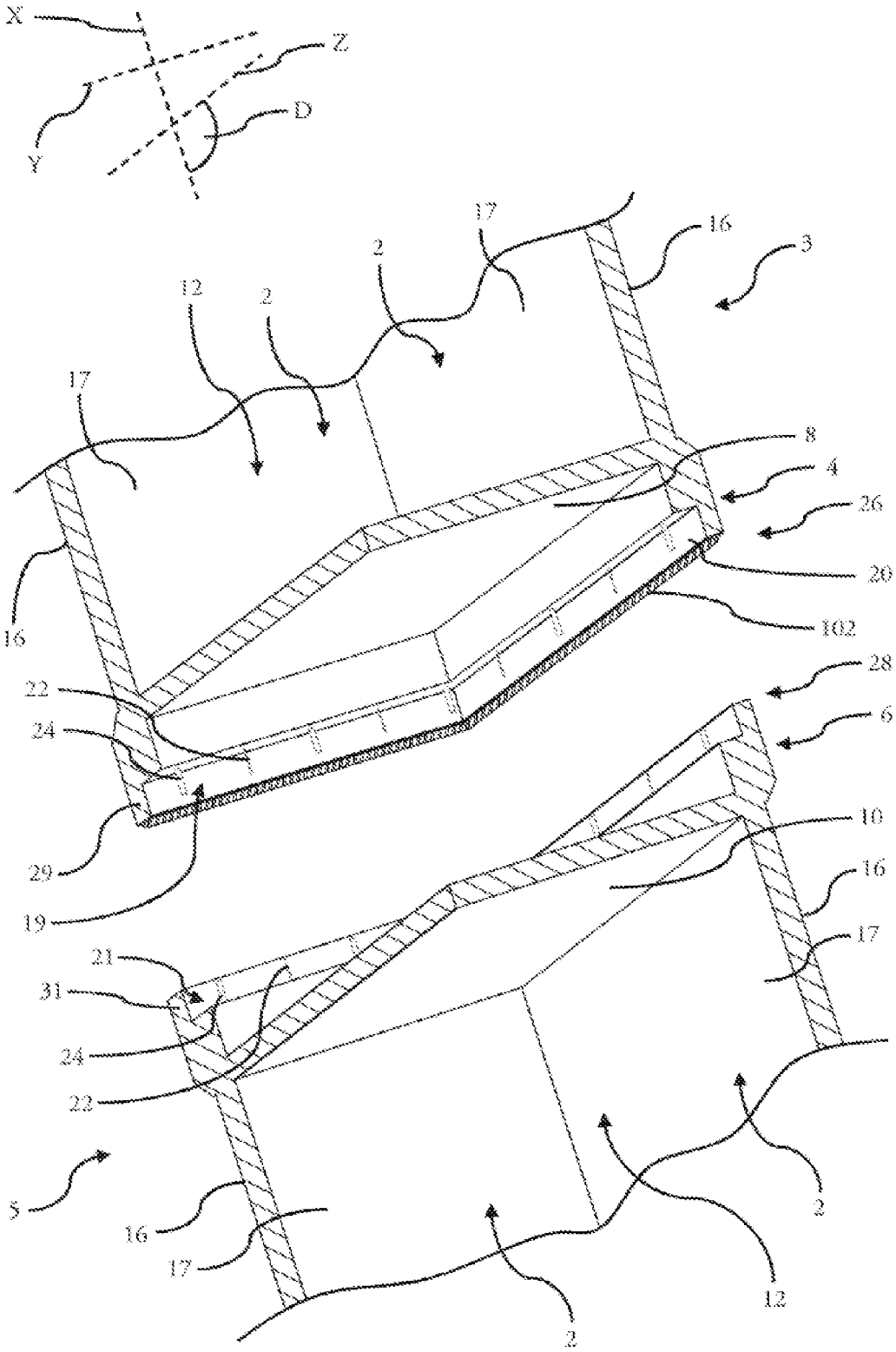

FIGS. 4 and 5 illustrate a partial view, respectively in cross section and in perspective, of an exemplary embodiment of a first floating module 3 and a second floating module 5 designed to be joined together in order to form a floating structure. Thus, FIGS. 3 and 4 illustrate the step of alignment in the assembly process according to the third aspect of the invention.

The first floating module and the second floating module are represented in FIG. 4 in a third plane F comprising the longitudinal axis X and the transverse axis Y. In other words, FIG. 4 is a top view, in cross section, of the first floating module and the second floating module.

Thus, a first longitudinal termination 26 of the first floating module is placed opposite a second longitudinal termination 28 of the second floating module. In this way, a cavity of the first floating module, called the first cavity 19, faces toward a cavity of the second floating module, called the second cavity 21. In a similar manner, the first extension 29 of the first floating module 3 is placed opposite the second extension 31 of the second floating module 5.

The first end stops 33 of the first floating module 3 face toward the second end stops 35 of the second floating module 5, the first end stops 33 being at a distance from the second end stops 35 of the second floating module 5.

On the other hand, each prestressing sheath 24 emerging from the first floating module 3, called the first prestressing sheath, faces toward a prestressing sheath 24 emerging from the second floating module 5, called the second prestressing sheath, to which it is going to be coupled. In a similar manner, each metal reinforcement 22 emerging from the first floating module 3, called the first metal reinforcement, faces toward a metal reinforcement 22 emerging from the second floating module 5, called the second metal reinforcement, to which it is going to be coupled.

Figure 6:
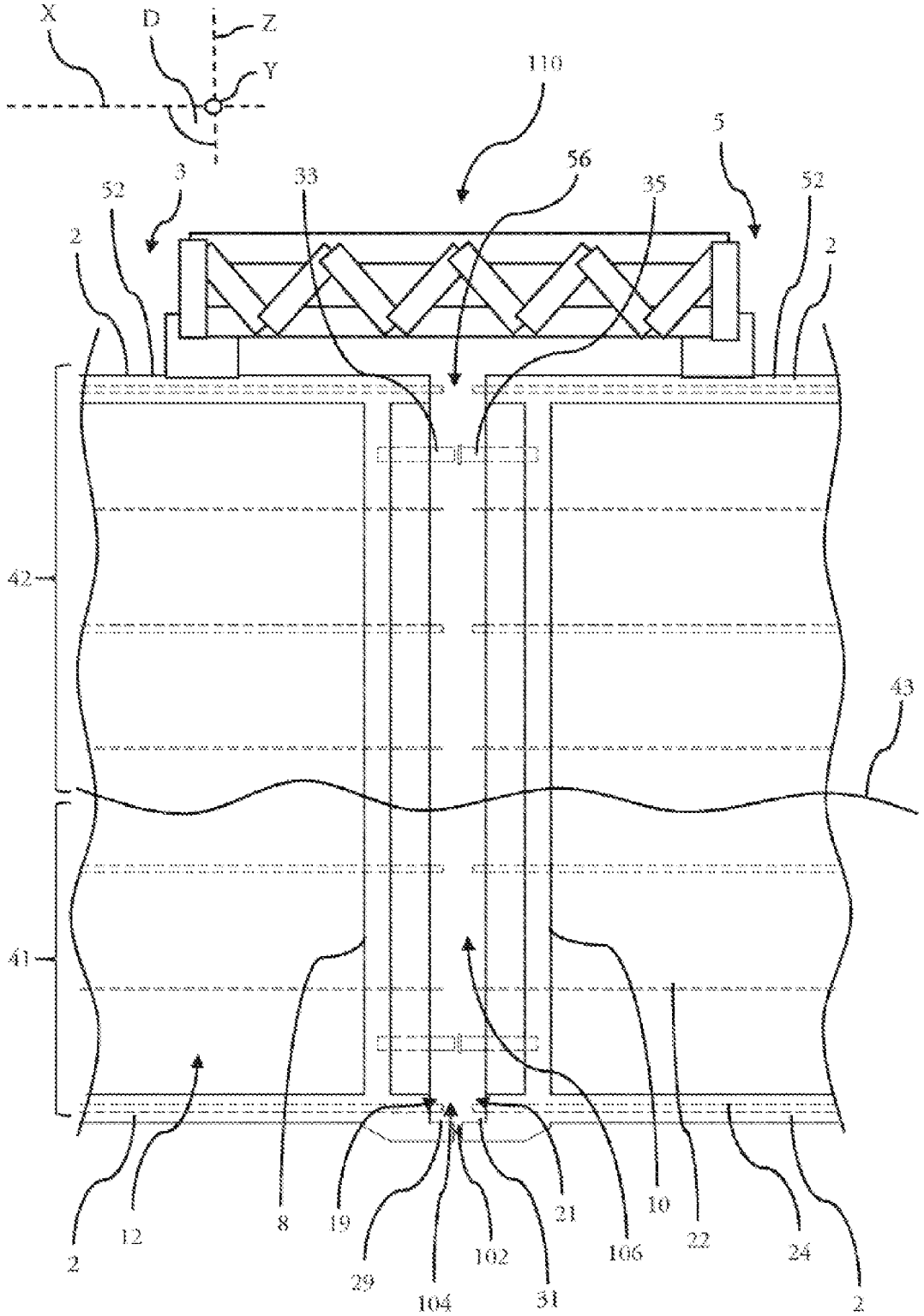
FIG. 6 is a partial view of an exemplary embodiment of a first floating module and a second floating module during the assembly process.

FIG. 6 is a partial view of an exemplary embodiment of a first floating module 3 and a second floating module 5 in the process of assembly. Thus, FIG. 6 illustrates the step of removable coupling in the assembly process according to the third aspect of the invention. The first floating module 3 and the second floating module 5 are illustrated in the first longitudinal and vertical plane D, FIG. 6 thus representing a side view of the first floating module 3 and the second floating module 5.

Thus, a connecting frame 110 ensures the position of the first floating module 3 relative to the second floating module 5. More particularly, the connecting frame 110, being a rigid structure, in particular one formed by a structure which is at least partly metallic, is secured on one wall 2, more particularly on an external face 16 of a wall, of the first floating module 3, and on one wall, more particularly on an external face 16 of a wall, of the second floating module 5. In the exemplary embodiment illustrated, the connecting frame 110 is secured on the upper wall 52 of the first floating module 3 and on the upper wall 52 of the second floating module 5. The securing of the connecting frame 110 on the second floating module 5 may be done prior to the securing of the connecting frame 110 on the first floating module 3. Thus, the second floating module 5 is brought closer to the first floating module 3 in order to become flush with the latter, so that the proximity between the first floating module 3 and the second floating module 5 is sufficient. The connecting frame 110 is then secured on the second floating module 5, thus assuring the relative position of the second floating module 5 with respect to the first floating module 3. Alternatively, the connecting frame 110 may be secured on the first floating module 3 and the second floating module 5 in a simultaneous, or nearly simultaneous, manner, once the proximity between the first floating module 3 and the second floating module 5 has been achieved.

When the proximity between the first floating module 3 and the second floating module 5 has been achieved, the scaling device 102 located in the area of the first longitudinal end 26 of the first floating module 3 and inserted between the first extension 29 of the first floating module 3 and the second extension 31 of the second floating module 5, said sealing device 102 is compressed between the first extension 29 and the second extension 31. Thus, the first cavity 19 and the second cavity 21 form a hollow 104, transversely bounded by the first extension and the second extension, the hollow being bounded longitudinally by the edge 11 of a wall of the first floating module 3 and the edge 11 of a wall of the second floating module 5. Moreover, the sealing device 102 likewise ensures the tightness of a space 106 bounded transversely by the first extension 29 and the second extension 31, the space 106 being bounded longitudinally by the first partition 8 of the first floating module 3 and by the second partition 10 of the second floating module 5.

It will thus be understood that the hollow 104 corresponds to the sum of the first cavity 19 and the second cavity 21, whereas the space 106 corresponds to the volume bounded vertically by the extensions 14 and longitudinally by the partitions 8,10 of the first floating module 3 and the second floating module 5.

The upper wall 52 of the first floating module 3 and the upper wall 52 of the second floating module 5 being both free of an extension, they thus form the passage 56 enabling access to the space 106, especially for the later steps of the joining together of the first floating module 3 and the second floating module 5, such as the step of emptying the space 106, or the step of mechanical connection between the metal reinforcements of the first floating module 3 and the metal reinforcements of the second floating module 5.

Hence, since the sealing device 102 ensures the tightness of the space 106, especially in the area of the lateral walls and the lower wall of the first floating module 3 and the second floating module 5, it is possible to carry out a step of emptying of that space 106. In fact, as the first floating module 3 and the second floating module 5 are assembled on a body of water, and thus each of them is partly submerged, water is therefore present inside the space 106 when the first floating module 3 and the second floating module are brought closer to each other. The step of emptying the space 106 thus allows a removal of the water present in the space 106, in order to carry out or facilitate the further steps in the joining together of the first floating module 3 and the second floating module 5.

The first end stops 33 of the first floating module 3, even though having been brought closer to the second end stops 35 of the second floating module 5, are still separated from the second end stops 35 of the second floating module 5, thus indicating that the first floating module 3 and the second floating module 5 need to be further brought closer in order to complete their assembly.

Figure 7:
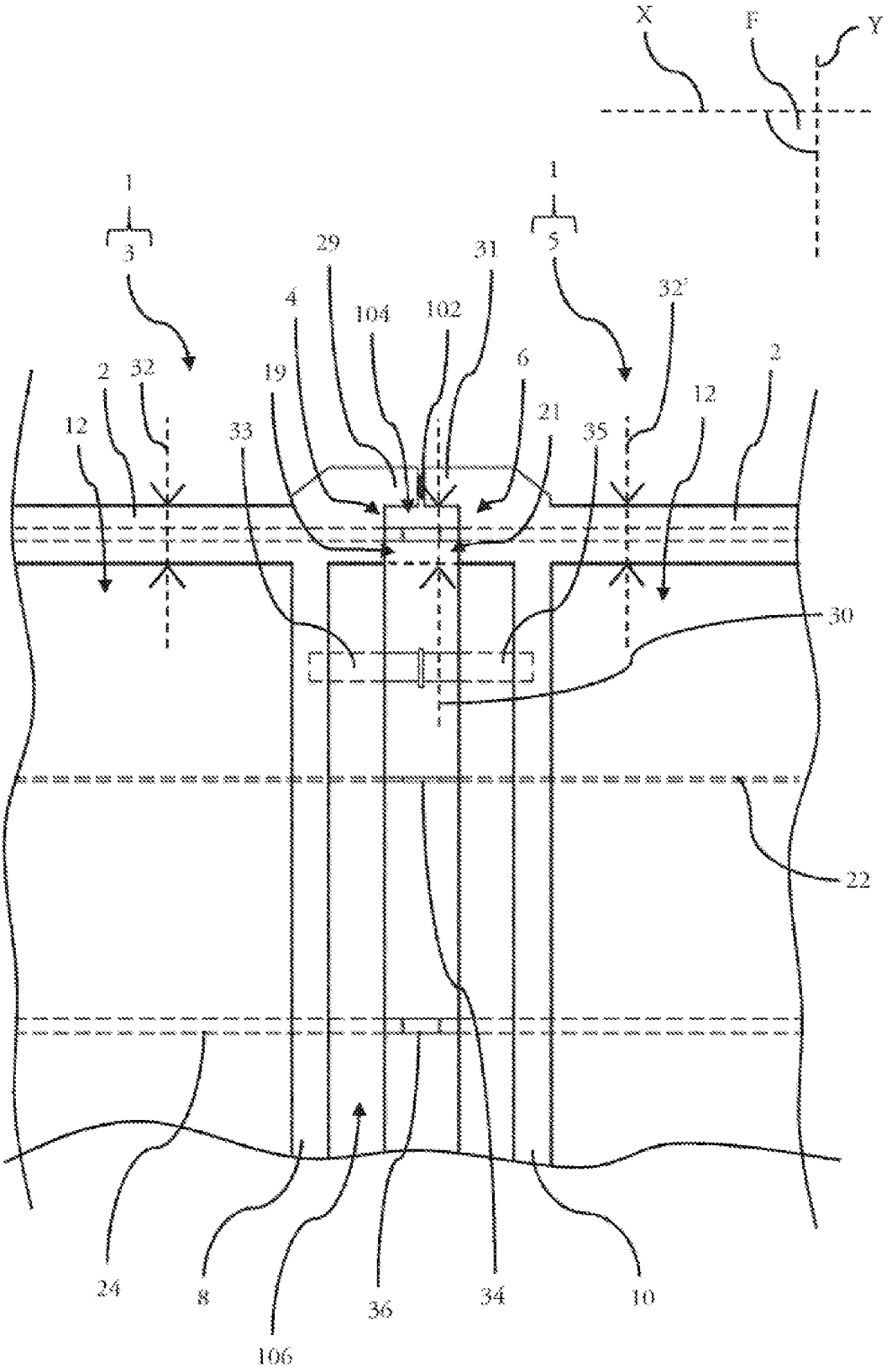
FIGS. 7 and 8 illustrate partial views, respectively in cross section and in perspective, of the first floating module and the second floating module visible in FIG. 6.
Figure 8:
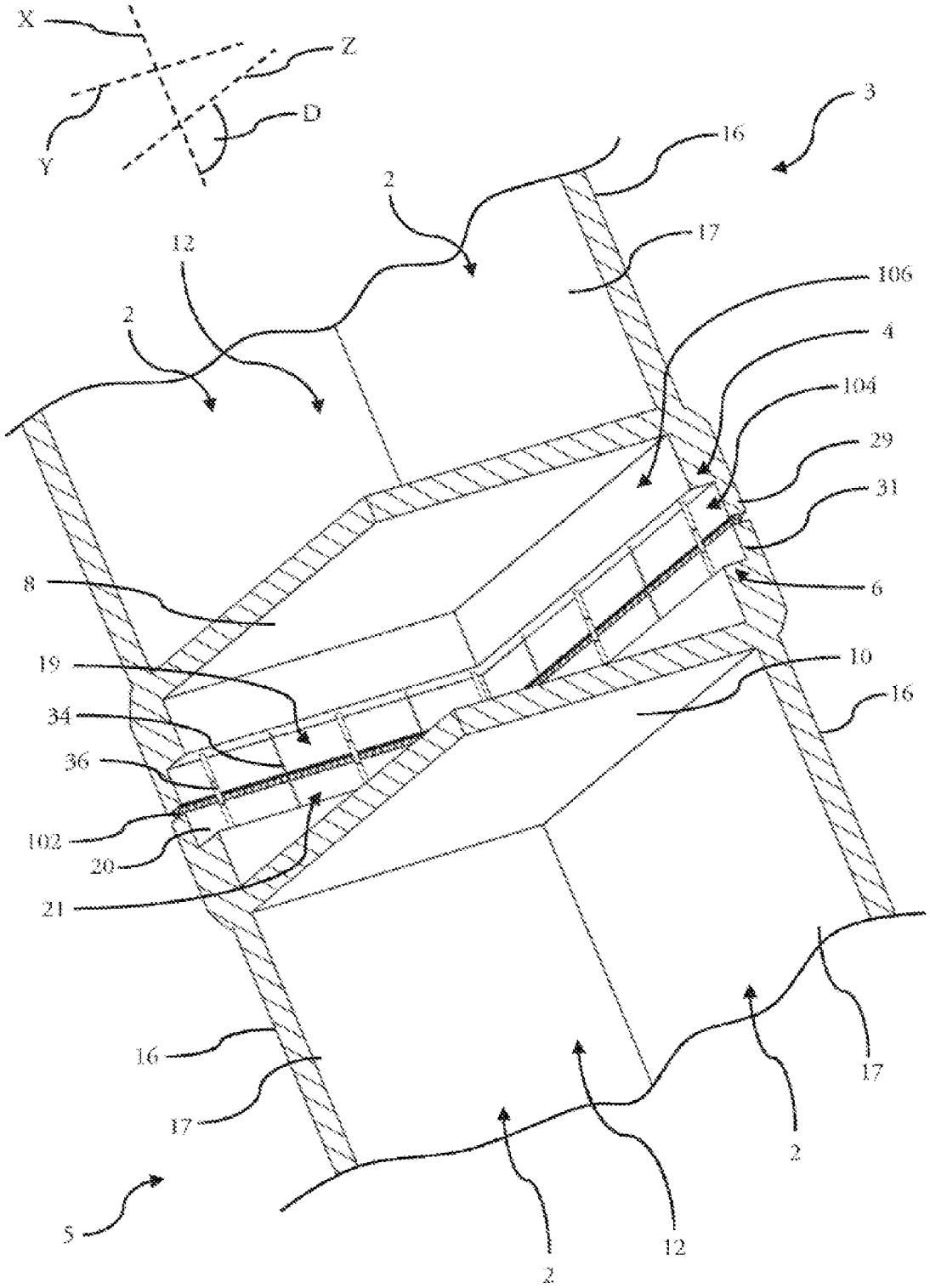

FIGS. 7 and 8 illustrate a view, respectively in cross section and in perspective, of the first floating module 3 and the second floating module 5 visible in FIG. 6. FIG. 7 illustrates the first floating module and the second floating module 5 in the third plane F, FIG. 7 being thus a top view. More particularly, FIGS. 7 and 8 illustrate a step of mechanical connection between the first floating module 3 and the second floating module 5. For better comprehension, the connecting frame 110 is not shown. FIG. 7 illustrates a top view, that is, in the first plane The first floating module 3 and the second floating module 5 are joined together by a mechanical connection step between the first metal reinforcement and the second metal reinforcement. The mechanical connection between the first metal reinforcement and the second metal reinforcement is provided by a coupler 34, thus ensuring that the first floating module 3 and the second floating module 5 remain abutting against each other. Moreover, the connection between the first metal reinforcement and the second metal reinforcement assures the transmission of mechanical forces, especially traction forces, between the first floating module and the second floating module.

In a similar manner, each first prestressing sheath is connected to a second prestressing sheath by a hollow sleeve 36, ensuring the tightness of the interior of each prestressing sheath 24 while allowing a communication between the interior of the first prestressing sheath and the interior of the second prestressing sheath, thus enabling the passing of the prestressing cable through said first prestressing sheath and said second prestressing sheath.

The mechanical connection step also allows one to ensure that the proximity between the first floating module 3 and the second floating module 5 is sufficient. In fact, the first floating module 3 is brought closer to the second floating module 5, in particular thanks to the connection between the first metal reinforcements and the second metal reinforcements by way of the coupler 34, so that the first end stops 33 of the first floating module 3 come to bear against the second end stops 35 of the second floating module 5. Thus, the first end stops 33 and second end stops 35 make it possible to identify when the proximity between the first floating module 3 and the second floating module 5 is sufficient, in particular to ensure a sufficient compression of the scaling device 102 inserted between the first floating module 3 and the second floating module 5, so as to assure the tightness of the space 106.

The mechanical connection step, that is, the connection of the first metal reinforcement to the second metal reinforcement by way of the coupler 34, as well as the connection between the first prestressing sheath and the second prestressing sheath by way of the sleeve 36, is facilitated if the emptying step has been performed previously, in the case when the first floating module 3 and the second floating module 5 are assembled on a body of water.

One may see in FIG. 7 that, in the embodiment illustrated, the thickness of the hollow 104, corresponding to the first dimension 30 of the cavity of the first floating module 3 as well as the first dimension 30 of the cavity of the second floating module 5, is equal to the second dimension 32 of the wall 2 of the first floating module 3. In a similar manner, the thickness of the hollow 104 is equal to a third dimension 32' of the wall of the second floating module 5, the third dimension 32' being measured between the external face 16 and the internal face 17 of the wall 2 of the second floating module 5. Thus, this configuration makes it possible to assure a total mechanical continuity between the first floating module and a second floating module, and to obtain a modular floating structure which behaves like a monolithic structure having the same mechanical strength as the standard section of a floating module, the floating structure thus having a continuity of material along the entire second dimension 32 and third dimension 32' between the first floating module 3 and the second floating module 5 by way of the hollow 104, the hollow being designed to be filled with concrete, and the thickness of the hollow 104 being equal to the second dimension 32 and to the third dimension 32'. On the other hand, the hollow is aligned along the vertical axis Z with the wall 2 of the first floating module and the wall 2 of the second floating module. More particularly, the external face 16 of the wall of the first floating module 3 and the external face 16 of the wall 2 of the second floating module 5 lie in the same plane, said plane being likewise the plane of extension of the internal face 20 of the first extension 29 of the first floating module 3 and of the internal face 20 of the second extension 31 of the second floating module 5. In a similar manner, the internal face 17 of the wall of the first floating module 3 and the internal face 17 of the wall 2 of the second floating module 5 lie in the same plane. This configuration makes it possible to assure a total mechanical continuity between the first floating module and a second floating module, and to obtain a modular floating structure which behaves like a monolithic structure having the same mechanical strength as the standard section of a floating module, in order to withstand the mechanical forces due to the floating structure between the first floating module 3 and the second floating module 5.

Figure 9:
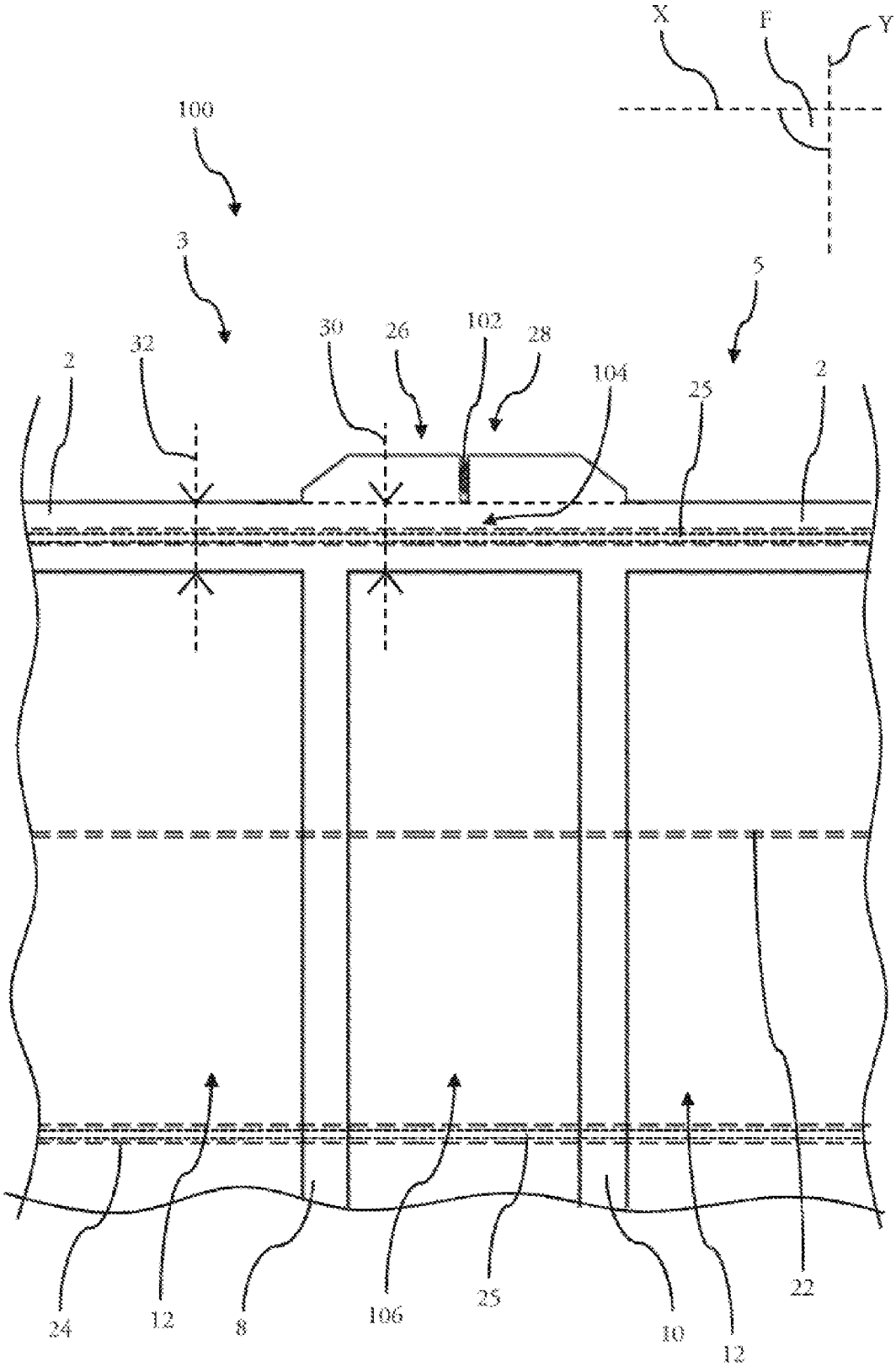
FIGS. 9 and 10 illustrate partial views, respectively in cross section and in perspective, of an exemplary embodiment of a floating structure according to the second aspect of the invention.
Figure 10:
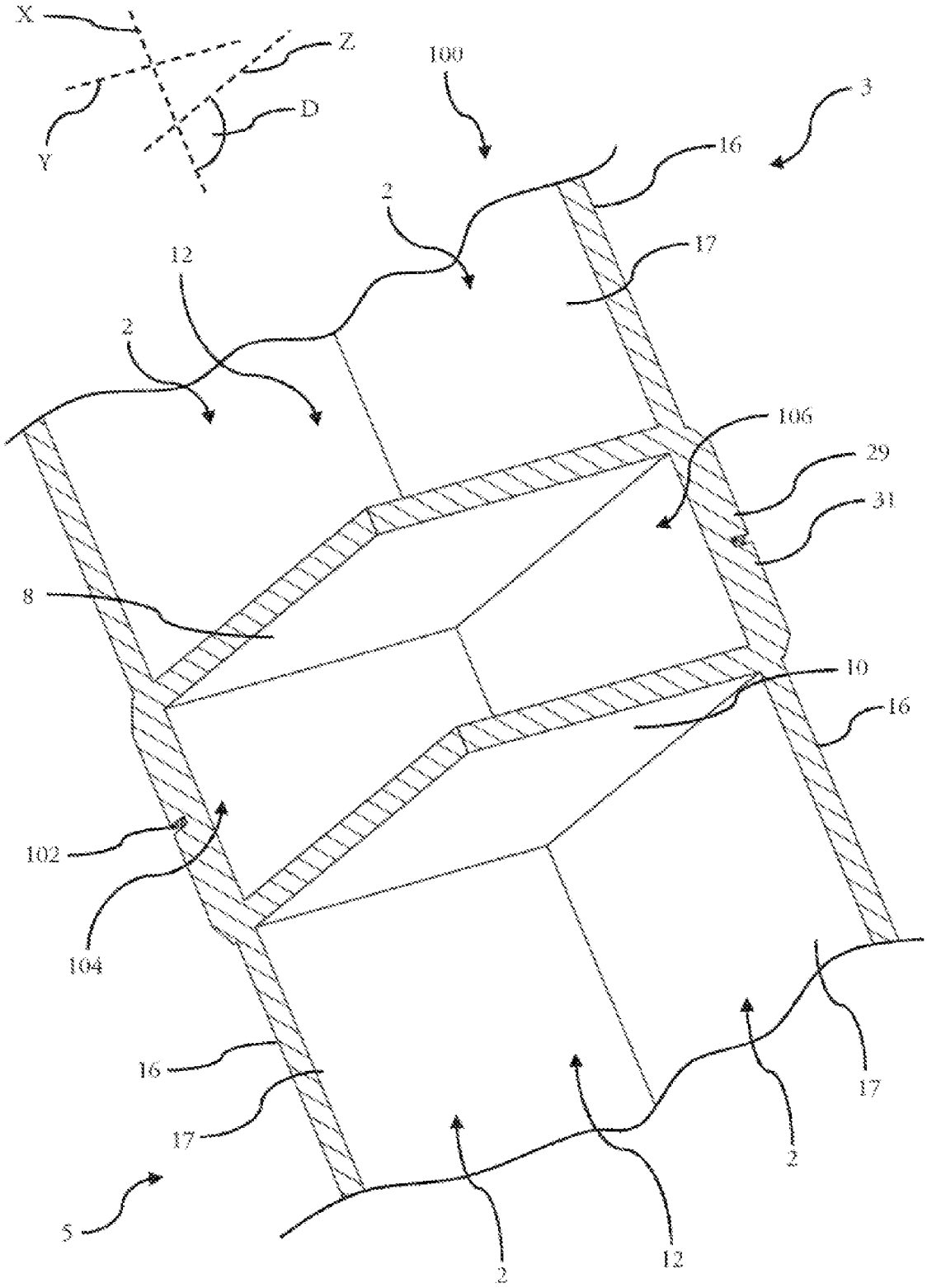

FIGS. 9 and 10 illustrate a partial view, respectively in cross section and in perspective, of an exemplary embodiment of a floating structure 100 according to the second aspect of the invention. FIG. 9 illustrates the floating structure 100 in the third plane F, FIG. 9 being thus a top view. More particularly, the floating structure 100 illustrated is formed by at least the first floating module 3 and the second floating module 5 visible in FIGS. 7 and 8.

Thus, once the coupler 34 and the sleeve 36 have been installed, as illustrated in FIGS. 7 and 8, thereby realizing the mechanical connection between the first floating module 3 and the second floating module 5, a material, especially concrete, is poured in the hollow 104 so that the first floating module 3 and the second floating module 5 form a monolithic assemblage. More particularly, the first longitudinal end 4 of the first floating module 3 is connected by way of the concrete poured in the hollow 104 to the second longitudinal end 6 of the second floating module 5. Thus, the hollow 104 formed by the first cavity 19 and the second cavity 21 extends along the first dimension 30. Hence, since the first dimension 30 is equal to the second dimension 32 corresponding to the thickness of the wall 2, this configuration allows the concrete present in the hollow 104 to transmit mechanical forces, especially compression forces, since it allows one to assure a total mechanical continuity between the first floating module and a second floating module, and to obtain a modular floating structure which behaves like a monolithic structure having the same mechanical strength as the standard section of a floating module, unlike a known configuration in which the first dimension of the hollow represents only a portion of the thickness of the wall.

It is also noted that the prestressing sheath 24 emerging into the hollow 104 is thus covered by the concrete present in the hollow. Thus, the prestressing cable 25 inserted inside the prestressing sheath 24 extends in the longitudinal axis of the wall of the first floating module 3 and the wall of the second floating module 5, inside said walls, thus allowing the compression force exerted by the traction force applied to the prestressing cable to be centered with respect to the wall of the first floating module 3 and the wall of the second floating module 5, especially as compared to a known configuration in which the prestressing cable extends longitudinally on the external face or on the internal face of the wall of the first floating module and the wall of the second floating module, so that the compression force exerted by the traction force applied to the prestressing cable is off-center.

Thus, a floating structure 100 having advantageously an extension 14 defining a cavity 18 on each of its walls presents an elevated resistance to the mechanical forces of compression, assured by the concrete poured in each cavity 18, which makes it possible to assure a total mechanical continuity between the first floating module and a second floating module, and to obtain a modular floating structure which behaves like a monolithic structure having the same mechanical strength as the standard section of a floating module. On the other hand, each wall 2 of the first floating module 3 is joined to a wall 2 of the second floating module 5 by a hollow 104 of concrete, traversed by a metal reinforcement 22 and/or a prestressing sheath 24, inside which is located a taut prestressing cable 25, so that the floating structure 100 presents an elevated resistance to the shearing and flexural movement exerted between the first floating module 3 and the second floating module 5, especially due to the motions caused by waves on the body of water where the floating structure 100 is situated.

FIGS. 11*a* and 11*b* illustrate a first mode of assembly and a second mode of assembly, respectively, of a first floating module 3 and a second floating module 5 designed to be connected to form a floating structure 100. FIGS. 11*a* and 11*b* illustrate top views, in the third plane F, of the first floating module 3, the second floating module 5 and the floating structure 100.

More particularly, FIG. 11*a* illustrates a basically rectangular floating structure 100 formed by a first floating module 3 and a second floating module 5 which are similar to each other and which extend primarily in the same direction.

FIG. 11*b* illustrates a floating structure 100 having an angle 57. In the exemplary embodiment illustrated, the angle 57 formed is a right angle, that is, the value is equal to 90°, measuring the angle between the principal axis of extension of the first floating module 3 and the principal axis of extension of the second floating module 5 to which the first floating module 3 is attached in order to form the floating structure 100. More particularly, the floating structure is formed by a first floating module 3 and a second floating module 5, the first floating module 3 having the angle 57, and the second floating module 5 being substantially rectilinear. The first floating module 3 thus comprises a prolongation 58 extending perpendicularly to the principal axis of extension of the first floating module 3. The second floating module 5 is joined to the prolongation 58 of the first floating module 3, thus enabling the formation of the floating structure 100 having the angle 57. This configuration thus allows one to obtain a great diversity of conformations of floating structure, the angle not being limited to the value of 90°, but able to take on any value, especially one between 90° and 180°, with an angle of 180° then forming a rectilinear floating module.

FIGS. 12*a* to 12*e* illustrate exemplary embodiments of a floating structure 100 according to the second aspect of the invention. More particularly, FIGS. 12*a* to 12*e* each illustrate a possible shape for a floating structure according to the second aspect of the invention, in the third plane F. In other words, FIGS. 12*a* to 12*e* are top views of the floating structure 100 illustrated in each of these figures, each floating structure 100 comprising in particular multiple floating modules 1 according to the first aspect of the invention.

The floating structures illustrated in FIGS. 12*a*, 12*b*, 12*c*, 12*d* and 12*e* form, respectively, a square, a rectangle, a regular hexagon, a circle, and a floating structure having a basically V-shape. It will be understood that the floating structure 100 may assume any other shape without leaving the scope of the invention.

Of course, the invention is not limited to the examples just described, and many arrangements may be added to these examples without leaving the scope of the invention. In particular, the different characteristics, shapes, variants and embodiments of the invention may be associated with one another according to various combinations, as long as they are not incompatible or mutually exclusive. In particular, all of the variants and embodiments described above can be combined with each other.

The invention, such as has been described here, well achieves the purposes which have been set, and makes it possible to propose a floating module making it possible to assure a total mechanical continuity between the first floating module and a second floating module, and to obtain a modular floating structure which behaves like a monolithic structure having the same mechanical strength as the standard section of a floating module. Variants not described here could be implemented without leaving the scope of the invention, as long as the floating module comprises, in accordance with the invention, an extension emerging from the external face of a wall, the extension extending longitudinally in projection from a longitudinal end of the wall, and the extension and the wall from which the extension emerges being made of integral material. The present invention makes it possible to connect two floating modules made of reinforced and prestressed concrete in the water, so as to ensure a total continuity of the concrete, the reinforcements, and the prestressed steel between the two floating modules joined together and having the same mechanical strength as the standard section of a floating module. It may be utilized to produce a monolithic floating structure of any given shape, made of concrete, and having a modular construction. The connection produced is tight and able to withstand, during the different phases of the lifetime of the project, the static and dynamic forces, the hydrodynamic forces, and the fatigue phenomena which are applicable to it by reason of the international regulations. This invention may be used in the construction of bridges, oil drilling platforms, ports, piers, floating platforms for renewable energy, in the nuclear field and in any other field.

The invention claimed is:

1. A floating module comprising a plurality of walls extending between a first longitudinal end and a second longitudinal end, the floating module comprising a first partition and a second partition connecting each wall of the plurality of walls, defining with these walls an internal volume of the floating module, the floating module comprises at least one extension emerging from an external face of the wall, the extension extending longitudinally in projection from the first longitudinal end or from the second longitudinal end, the extension and the wall from which the extension emerges being materially integral, characterized in that one edge of one longitudinal end of the wall and the extension bound a cavity, at least partly, wherein a thickness of the cavity is equal to or greater than a thickness of the wall from which the extension emerges.

2. The floating module according to claim 1, wherein the external face of the wall and an internal face of the extension lie in the same plane.

3. The floating module according to claim 1, wherein the extension is situated on each of the lateral walls of the floating module and on a bottom wall of the floating module.

4. The floating module according to claim 1, wherein the wall comprises a first extension situated in the area of the first longitudinal end and a second extension situated in the area of the second longitudinal end.

5. The floating module (1) according to claim 1, wherein the plurality of walls, the first partition, the second partition and the extension are formed of integral material, said material being concrete.

6. The floating module according to claim 1, wherein a metal reinforcement extends inside one wall and emerges into the cavity.

7. The floating module according to claim 1, comprising a prestressing sheath extending inside one wall and emerging into the cavity.

8. A floating structure comprising at least one floating module according to claim 1.

9. The floating structure according to claim 8, wherein the at least one floating module includes a first floating module and a second floating module, wherein a sealing device is located between the first floating module and the second floating module, the sealing device being inserted between an extension of the first floating module and an extension of the second floating module.

10. The floating structure according to claim 9, wherein a hollow bounded by a cavity of the first floating module and by a cavity of the second floating module is filled with concrete.

11. The floating structure according to claim 10, wherein a continuity between a metal reinforcement of the first floating module and a metal reinforcement of the second floating module, and/or a continuity between a prestressing sheath of the first floating module and a prestressing sheath of the second floating module is realized in the hollow.

12. The floating structure according to claim 10, wherein a thickness of the wall of the first floating module is equal to a thickness of the wall of the second floating module, the thickness of the wall of the first floating module and the thickness of the wall of the second floating module being equal to a thickness of the hollow.

13. A method for assembling a floating structure according to claim 10, the assembly method involving a step of alignment of the first floating module relative to the second floating module, a step of removable coupling of the first floating module to the second floating module, and a step of casting concrete in the hollow.

14. The method of assembly according to claim 13, the assembly method involving a step of emptying a space bounded by the partitions, by the extension of the first floating module and by the extension of the second floating module.

15. The method of assembly according to claim 13, the assembly method involving a step of mechanical connection between a metal reinforcement of the first floating module and a metal reinforcement of the second floating module.

16. The method of assembly according to claim 13, the assembly method involving, after the step of concrete casting, a step of installation of at least one prestressing cable laid in a prestressing sheath of the first floating module and in a prestressing sheath of the second floating module, a traction force being then applied to the prestressing cable.

* * * * *